US006481018B2

(12) United States Patent
Gagnon et al.

(10) Patent No.: US 6,481,018 B2
(45) Date of Patent: Nov. 19, 2002

(54) FIREPROOF COLLAR FOR A FIREFIGHTER'S COAT

(75) Inventors: Marie Gagnon; Jef Stewart, both of Richmond (CA)

(73) Assignee: Innotex Inc., Quebec (CA)

( * ) Notice: Subject to any disclaimer, the term of this patent is extended or adjusted under 35 U.S.C. 154(b) by 0 days.

(21) Appl. No.: 09/797,140

(22) Filed: Mar. 1, 2001

(65) Prior Publication Data

US 2002/0120975 A1 Sep. 5, 2002

(30) Foreign Application Priority Data

Feb. 23, 2001 (CA) ..... 2338838

(51) Int. Cl.[7] ..... A41D 3/02
(52) U.S. Cl. ..... 2/98; 2/81
(58) Field of Search ..... 2/135, 455, 458, 2/468, 97, 98, 129, 81–82, 85, 108, 272, 93, DIG. 5

(56) References Cited

U.S. PATENT DOCUMENTS 3,137,008 A * 6/1964 Abalman ..... 2/98
4,507,806 A 4/1985 Coombs
4,604,759 A 8/1986 Bowman et al.
4,748,691 A 6/1988 Grilliot et al.
4,774,725 A * 10/1988 Page ..... 2/81
4,999,850 A 3/1991 Grilliot et al.
5,127,106 A 7/1992 Aldridge
5,153,941 A 10/1992 Grilliot et al.
5,189,737 A 3/1993 Ribicic
5,274,850 A 1/1994 Aldridge
5,406,648 A 4/1995 Butzer et al.
5,532,037 A 7/1996 Aumann
5,638,547 A 6/1997 Hewitt
5,842,229 A 12/1998 Snedeker
5,873,132 A 2/1999 Grilliot et al.
5,884,332 A 3/1999 Snedeker
5,991,924 A 11/1999 Grilliot et al.
6,006,360 A * 12/1999 Reed ..... 2/202

* cited by examiner

*Primary Examiner*—John J. Calvert
*Assistant Examiner*—Tejash Patel
(74) *Attorney, Agent, or Firm*—Timothy J. Keefer; Wildman, Harrold, Allen & Dixon

(57) ABSTRACT

In a firefighter's protective garment, having a detachable outer flame-resistant shell and an inner thermal, i.e. heat, protective liner, the neck portion of the liner extending upright beyond an over-the-neck portion of the shell and fastening on the outside of the neck portion of the shell, such that the whole of the neck of a firefighter is protected by both a heat protective material and a fire protective material.

8 Claims, 4 Drawing Sheets

FIREPROOF COLLAR FOR A FIREFIGHTER'S COAT

CROSS REFERENCE TO RELATED APPLICATION

This application claims the priority of Canadian patent application filed on Feb. 23, 2001. Canadian application number 2,338,838.

BACKGROUND OF THE INVENTION

The present invention relates to a collar system incorporated into a firefighter's coat. Firefighters must wear protective clothing which must be adapted for use in extremely dangerous conditions. In fighting a fire, the flames and/or heat to which a firefighter is exposed may be of such an intensity that unless properly protected, serious injury or death of the firefighter may occur. To that end, various organizations and/or government bodies have set standards which must be adhered to with respect to the level of protection which a firefighter's clothing is to afford a firefighter.

One of the most important specifications which must be followed in the design and manufacture of firefighting garment is that the garment must provide at least one complete layer of flame-resistant material and must also comprise a complete layer of heat-resistant material and further comprise a layer of moisture barrier material. The flame-resistant material is in the form of a shell which is fitted over and above the heat-resistant layer, also known as a liner, which liner may also comprise the moisture barrier. It is critical that wherever there is a flame-resistant shell, there must be at least one heat-resistant layer intermediate the firefighter and said flame-resistant shell, in other words, no part of a firefighter body (except maybe for the head and face) may be without a layer of flame resistant material and a layer of heat resistant material. The presence of a gap, i.e. the absence of a thermal liner which does not protect a portion of the firefighter, could, in a blaze, i.e. a hot blaze, cause serious injury to that portion of the body of the firefighter not covered by the thermal liner.

This shortcoming may be particularly acute in the neck area of a firefighter's coat. The prior art discloses various different types of a firefighter's coat, incorporating various designs regarding the neck thereof. For example, U.S. Pat. No. 5,638,547 to Hewitt discloses a firefighter's coat wherein the collar part comprises an outer collar part and an inner collar part having a moisture barrier disposed therebetween. However, Hewitt does not disclose a firefighter coat having a collar area comprising an outer flame-resistant layer and an inner thermal protection layer. Further, U.S. Pat. No. 4,507,806 to Coombs discloses a firefighter's coat wherein the collar comprises an outer flame-resistant shell and an inner thermal liner, however, the outer flame-resistant shell does not completely enclose the neck area. Finally, U.S. Pat. No. 4,604,759 to Bowman et.al. discloses a collar comprising an outer flame-resistant shell and an inner thermal liner which is permanently attached one to the other, i.e. through sewing, which comprises serious shortcomings regarding the cleaning, repair or replacement of the liner if necessary.

It is therefore an objective of the present invention to provide a firefighter's coat comprising a collar system wherein the whole height of the collar comprises an outer flame-resistant shell layer and an inner thermal protection liner.

It is a further objective of the present invention to provide for a firefighter's coat wherein the thermal protection liner of the collar portion is detachable from the outer shell.

It is also an objective of the present invention to provide for a firefighter's coat wherein the thermal protection liner of the collar portion is detachable from the outer shell through the use of quick release attachment means.

It is a further objective of the present invention to provide the attachment of the inner thermal liner portion of the neck to the flame-resistant shell at the neck area thereof adjacent the uppermost edge of the neck portion.

It is yet another objective of the present invention to provide for the shell collar portion and the liner collar portion to be releasably attached to each other through the use of a minimum quantity of fabric.

SUMMARY OF THE INVENTION

The present invention is directed to a firefighter's coat comprising a collar portion. In accordance with an aspect of the present invention, the firefighter's coat may comprise at least three separate and distinct layers, an exterior flame-resistant shell, an inner thermal protection liner and a moisture barrier layer. Throughout this description portion of this specification only, the moisture barrier may not be described, but it is understood to be included in the expression thermal protection liner. The shell may naturally cover most, if not all, of the firefighter's body, including the legs, abdomen, torso, back, arms and neck. The inner liner may also cover the same parts of the body as the outer shell, and in accordance with a particular embodiment of the present invention, may cover exactly the same surface as the outer shell. It is understood that the inner liner may be disposed intermediate i.e. between the skin of the firefighter and the outer shell, and in accordance with further embodiments of the present invention, additional layers may be provided in addition to the inner liner, to provide for additional fire and heat protection, or in order to add further moisture barriers, or in order to provide layers which will make the wearing of the firefighting equipment more comfortable for the firefighter. In accordance with a further aspect, the firefighter's coat may comprise a one-suit, or a pant and jacket combination or any other combination thereof.

In accordance with the present invention, the firefighter's coat is provided with specific protection for the neck area of the firefighter. Thus, in order to provide as much protection as possible to the neck area of a firefighter, the neck portion of the firefighter's coat is provided with a collar extending circumferentially from the upper torso and shoulder portions of the jacket. In accordance with a particular embodiment, the collar may, for example, extend vertically, the whole height of a firefighter's neck, abutting the mandible of the firefighter, and extending immediately below the earlobe of the firefighter.

Therefore, in accordance with an aspect of the present invention, there is provided for:

a garment suitable for use by a firefighter, said garment comprising an outer, flame-resistant shell having a shell body for covering the torso and arms and a shell neck portion, said shell neck portion having a top edge, and an inner, heat-resistant liner having a liner body portion for covering the torso and arms and a liner neck portion, said liner neck portion having a top edge wherein when said garment is worn by a firefighter, the top edge of said shell neck portion is disposed adjacent to the top edge of said liner neck portion.

In accordance with a further aspect of the present invention, there is provided for a:

garment suitable for use by a firefighter, said garment comprising an outer, flame-resistant shell having a shell body for covering the torso and arms and a shell neck portion, and an inner, heat-resistant liner having a liner body portion for covering the torso and arms and a liner neck portion, said shell neck portion having a top edge and said liner neck portion having a top edge, wherein when said garment is worn by a firefighter, the top edge of said shell neck portion is disposed adjacent to the top edge of said liner neck portion, and wherein the top edge of said liner neck portion comprises a protrusion projecting therefrom, said protrusion being sized and configured to be folded down over the top edge of said shell neck portion such that the top edge of said shell neck portion abuts said protrusion, said protrusion and said liner neck portion comprising cooperating fastener means for removably securing said protrusion to said shell neck portion adjacent the top edge of said shell neck portion.

Further, in accordance with an additional aspect of the present invention, there is provided for a:

multi-layer garment for use by firefighters comprising an outer flame-resistant shell having a body and a shell neck portion projecting circumferentially therefrom, said shell neck portion having a superior edge, an inner heat-protective liner having a body and a liner neck portion projecting circumferentially therefrom, said liner neck portion having a top edge wherein said shell neck portion and said liner neck portion vertically overlap one another such that said superior edge and said top edge are adjacent one another, said liner neck portion comprising a flap permanently affixed thereto along a hinge line adjacent said top edge, said flap projecting from said top edge, said flap being configured and disposed to fold outwardly at said hinge line over said superior edge, such that said superior edge and said flap are in contact with each other when said flap is folded over, said flap and said liner neck portion comprising cooperating fastener means for removably securing said flap to said liner neck portion.

In accordance with a particular embodiment of the present invention, a firefighter's coat may comprise a body portion and a collar portion extending circumferentially therefrom. Thus, the outer, flame resistant shell and the inner heat resistant liner of the firefighter's coat may each comprise a body portion and a collar portion extending circumferentially therefrom. In accordance with an embodiment of the present invention, the collar portion of the outer shell and the collar portion of the inner liner may be simply juxtaposed, i.e. may be placed one besides the other, for example, placed side by side such that the inside surface of the collar portion of the outer shell may be adjacent to and may be in contact with the outside surface of the collar portion of the inner liner. The height of the collar portion of the outer shell may be as high as the collar portion of the inner liner, such that there are no gaps, i.e. no vertical gaps, in the fire protection and the thermal protection afforded the wearer of the garment. The absence of gaps may best be understood as meaning that the whole neck of the firefighter wearing the garment of the present invention may be covered by at least one layer of flame-resistant outer shell and simultaneously, by at least one layer of inner thermal protection liner.

For example, in accordance with a particular aspect of the present invention, the collar portion of the outer shell and the collar portion of the inner liner may each be four inches high, i.e. they may project 4 or more inches from the respective bodies of the shell and of the liner. It is understood however, that the outer shell collar and the inner shell collar may each project more or less than 4 inches, and may project a sufficient height such that the upper edge of the collar portion of the outer shell and the upper edge of the collar portion of the inner liner may push up against the jaw (i.e. mandible) and earlobes of the firefighter. The height of the projection may be a function of the size of the firefighter's coat, and may naturally be higher for a large, or tall firefighter. In accordance with this particular embodiment, the collar portion of the outer shell and the collar portion of the inner shell are not connected (not joined, whether permanently or removably) to one another, they may simply stand side by side. Naturally, they may touch, i.e. rub against each other.

In accordance with a further embodiment of the present invention, the collar portion of the outer shell and the collar portion of the inner liner may be permanently affixed one to another. In accordance with this embodiment, the expression "permanently affixed" may be understood to mean that the collar portion of the outer shell and the collar portion of the inner liner may be sewn together, at any convenient or desired location along the length of the circumferential collar. It is understood that the fixation means used to effect the permanent connection may include other means than sewing, such as, for example, gluing.

In accordance with a further embodiment of the present invention, the collar portion of the outer shell and the collar portion of the inner liner may be provided with attachment means such that the collar portion of the inner liner may be removably attached to the collar portion of the outer shell. It is understood that in accordance with this embodiment, the attachment means may comprise any of a number of possible attachment means and may in particular comprise quick release attachment means. For example, the attachment means may comprise any number or combination of snap-on attachment means (i.e. press-fit attachment means), loop-and-pile attachment means (also known by its trademark VELCRO), a zipper®, also known as a slide fastener or any other attachment means as required or desired.

In accordance with this further embodiment of the present invention, the removable fastening or attachment of the collar portion of the inner liner to the collar portion of the outer shell may be effected along the upper edges thereof. For example, the inside (i.e. towards the user or wearer of the garment) of the collar portion of the outer shell may comprise a component of a quick-release attachment means, for example one of either of the two components of loop-and-pile attachment means, and the outside face of the collar portion of the inner liner may comprise the other of the components. Alternatively, in accordance with a further embodiment, the fastener means may be disposed along the upper edges or anywhere else along the opposing faces of the collar portion of the inner liner and the collar portion of the outer shell. Regardless of the position of the attachment means, the height of the collar portion of the outer shell may be the same as the height of the collar portion of the inner liner.

In accordance with yet a further embodiment of the present invention, the removable attachment of the collar portion of the inner liner to the collar portion of the outer shell may be effected through the use of a flap (or tab, or projection, etc . . . ) which may project from the upper edge of either of the collar portion of the inner liner or from the collar portion of the outer shell. The flap may, for example, comprise one or more extensions of the collar portion of the inner liner, i.e. such that the collar portion of the inner liner may, in parts, be higher than the collar portion of the outer shell, and may therefore protrude upwardly over and above the uppermost edge of the collar portion of the outer shell. This may allow for the protruding flap of the collar portion of the inner liner to be folded outwardly and back down over the outsidemost surface of the collar portion of the outer shell. Conversely, the collar portion of the outer shell may be comprise a flap, i.e. it may be (in parts) taller or higher than the collar portion of the inner liner, and may be folded over inwardly (towards the wearer) over the uppermost edge of the collar portion of the inner liner. However, in either of these embodiments, the collar portion (of the outer shell or of the inner liner) to be folded over the other collar portion must be done in such a manner that there is no gap, i.e. there is no area of the firefighter's neck which is not protected by at least one layer of fire-retardant material and one layer of heat-resistant material.

The use of a flap which is made to be folded over may cause what may be termed as "bunching" of extra material along the folding point. This may be due to the increased circumference of the outermost edge of this flap, in comparison with the circumference of the flap along its folding point. This bunching of material may cause ridges which may be either uncomfortable for the firefighter wearing the garment, or which may create openings through which heat and/or flames may infiltrate and cause injury to the firefighter in a fire. In order to minimize and/or eliminate this problem, the collar portion of the inner liner may comprise a hinge at or near its uppermost edge, so as to facilitate the folding over of a protruding flap. This hinge may, for example, take the form of a seam which may be created by the sewing at or adjacent the upper edge of the collar portion of the inner liner of a separate and distinct piece of material. This sewed on piece of material may be, for example, a flame-resistant material. The presence of the seam may facilitate the folding of the material over the upper edge of the collar portion of the shell, and the removable attachment thereto. As may be understood, this piece of material may be sewn to the upper edge of the collar portion of the inner liner along the whole length thereof, or may be sewn in one or more discreet positions, i.e. spaced apart along the upper edge thereof.

In accordance with an additional embodiment of the present invention, the collar portion of the outer shell may extend circumferentially from the body portion such that there are no horizontal gaps in the flame-resistant material, i.e. longitudinal gaps along its circumference, for example, in the front neck area of the collar portion. Thus, as may be understood, a lateral (vertical) edge of the collar portion may either overlap or may abut the opposed lateral edge of the collar portion such that when the coat is worn by a firefighter, the lateral, i.e. vertical, edge of the collar portion overlaps the opposite lateral edge thereof. Further, in accordance with the same embodiment, the inner liner may similarly not have any gaps therein such that, for example, the front neck area of the firefighter may be completely covered with an inner thermal heat protection liner.

In accordance with the present invention, the flame-resistant outer shell may be made from any number of commercially available fabrics and/or materials, such as, for example Nomex 111, sold as Brigade or PBI/Kevlar, both sold by Difco Inc. Further, the heat or thermal resistant inner liner may be made from any number of commercially available materials such as 3 layer virgin Nomex fiber Batting, sold as XE-389 by Difcon Inc. The moisture barrier may made from any number of commercially available fabrics and/or materials, such as, for example Hydrofilic moisture barrier sold as Stedair 2000 by Stedfast.

BRIEF DESCRIPTION OF THE DRAWINGS

A better understanding of the present invention as well as other objects and advantages thereof may become apparent upon consideration of the detailed disclosure thereof, especially when taken with the accompanying drawings wherein.

DETAILED DESCRIPTION OF THE DRAWINGS

Figure 1:
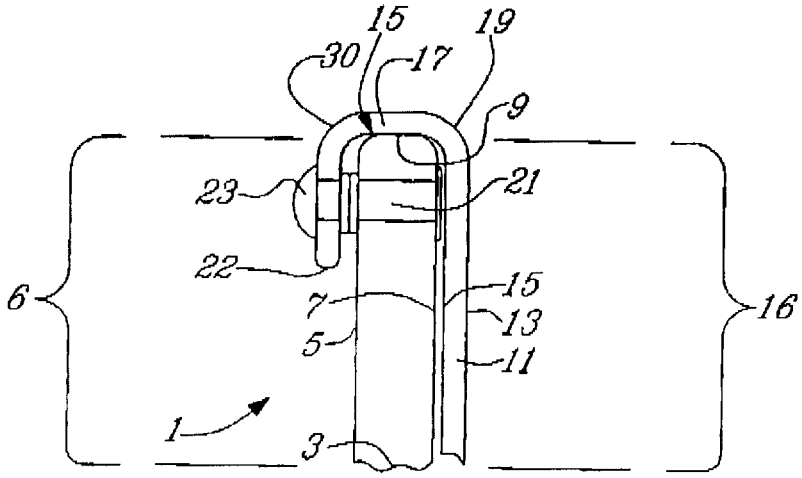
FIG. 1 is a side view of the shell neck portion and the liner neck portion.

Referring to FIG. 1, there is illustrated a side view of the collar portion 1 of a firefighter's coat or garment of the present invention. As illustrated, the collar portion 1 comprises at least two layers of material, namely an outer flame-resistant shell 3 and an inner thermal or heat-protective liner 11. As explained above, the thermal protection liner 11 may also comprise a moisture barrier (not shown for the sake of clarity). Each of the shell collar portion 3 and the liner collar portion is shown to have a height designated by reference numbers 6 and 16 respectively which height may be sufficient to cover the whole height of a firefighter's neck (not shown). Thus, as may be understood, heights 6 and 16 may vary in accordance with the sizing of the coat, for example a small-sized coat worn by a small-framed firefighter may have a shorter neck than a large-sized coat to be worn by a larger firefighter. In any event, heights 6 and 16 may be equal and may be of a height sufficient to cover the whole height and circumference of a firefighter's neck.

Liner collar portion 11 may, in addition to its height 16, comprise a projection or a flap designated by reference number 17, which flap 17 may be configured and disposed so as to project upwardly over and down onto the outside surface 5 of shell collar portion 3. Flap 17 may therefore drape over shell collar portion 3. In accordance with the embodiment illustrated in FIG. 1, flap 17 may be fitted at or near its outermost extremity 22 with a fastener mean, such as for example, a quick-release fastener mean 23 which may be positioned so as to cooperate with a corresponding fastener mean, such as a corresponding quick-release fastener mean 21 which may be disposed at or near the top edge 9 of the shell collar portion 3. The cooperation between fastener mean 23 and fastener mean 21 may cause the shell collar portion 3 and the inner liner portion 11 to be removably fastened one to the other, and may allow for the removal of the inner liner from the firefighter's coat for cleaning, repair, replacement, and so on.

FIG. 1 illustrates the manner in which no vertical gap may be present in the collar portion of the firefighter's coat, as the top (or upper, or uppermost) edge 9 of the shell collar portion 3 is made to be in contact (for example, continuous contact) with a portion of the outer surface 15 of flap 17. The size and configuration of flap 17, as well as the location of cooperating fastener means 23 and 21 may be such that in the action of bending flap 17 outwardly, i.e. towards outer surface 5 of shell collar portion 3, flap 17 may be pulled tightly or snugly, over top edge 9, therefore causing physical contact between surface 15 and top edge 9 so as to prevent any gaps therebetween. As may be understood from FIG. 1, the location of cooperating fastener means 21 adjacent the upper edge 9 of shell collar portion 3 may minimize the size of flap 17, so as to economize on the use of material of the liner collar portion 11.

Although not illustrated in FIG. 1, the liner collar portion may be also provided with a flame-resistant material thereon, such that, for example, surface 30 of flap 17 which is oriented outwardly towards a fire, may be provided with a flame-resistant material so as to be able to withstand damage from flames (not shown).

Figure 2:
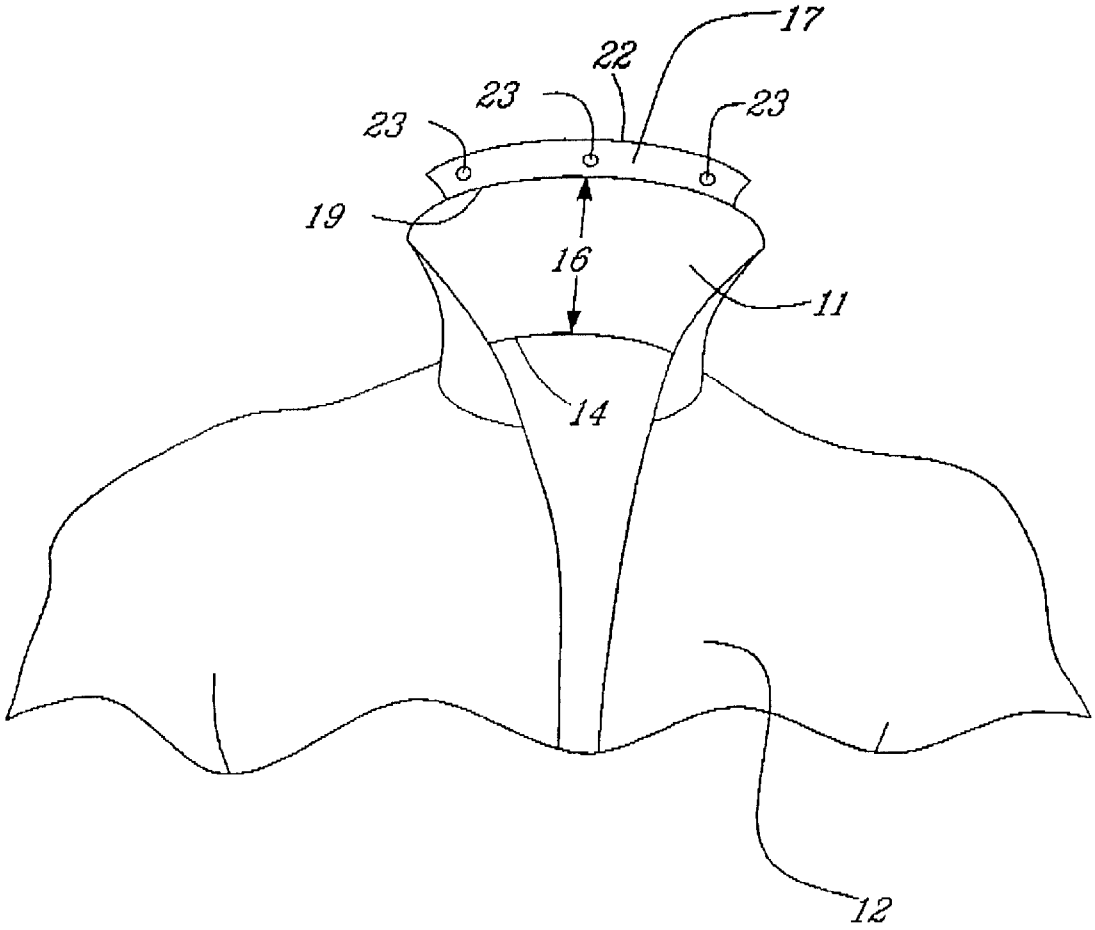
FIG. 2 is a front elevation view of the heat-resistant liner.

FIG. 2 is a front elevation view of the liner 12 comprising a liner collar portion 11. As may be apparent, liner collar portion 11 comprises a projection or flap, or extension 17 which projects outwardly therefrom. Flap 17 may be configured and disposed so that it may be folded outwardly, as illustrated in FIG. 1, along fold line 19. As may be understood, fold line 19 may act as a hinge allowing the smooth and easy folding of the flap 17 outwardly so that liner collar portion 11 may be removably fastened to the shell collar portion 3 as illustrated in FIG. 1. As shown in FIG. 2, cooperating fastener means 23 may be the press-fit type fastener means, but it is understood that the press-fit fastener means 23 may be replaced with any other fastener or quick-release fastener means or combination thereof, such as, for example, loop-and-pile fastener means (known as VELCRO™), or slide fastener mean (known as zippers) the whole in order to effect the releasable attachment of the shell collar portion and the liner collar portion together.

Figure 3:
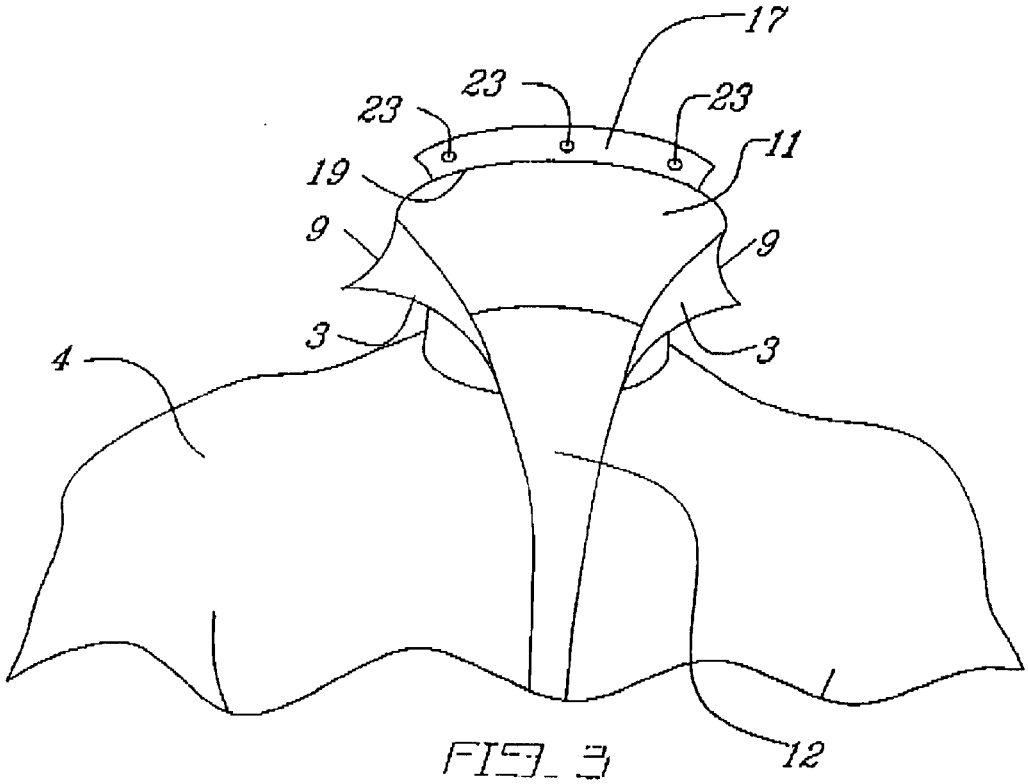
FIG. 3 is a front elevation view of the firefighter's coat showing the flame-resistant outer shell and the heat-resistant inner liner.

FIG. 3 illustrates front elevation view of a firefighter's coat shown comprising an outer shell 4 and an inner liner 12 disposed therein. As illustrated, shell collar portion 3 is shown projecting from the outer shell 4 and the liner collar portion 11 shown projecting from the inner liner 12. The relative disposition of the shell collar portion 3 and the liner collar portion 11 is that the liner collar portion 11 is disposed inside, such that it is disposed between the firefighter's body and the outer shell.

Figure 4:
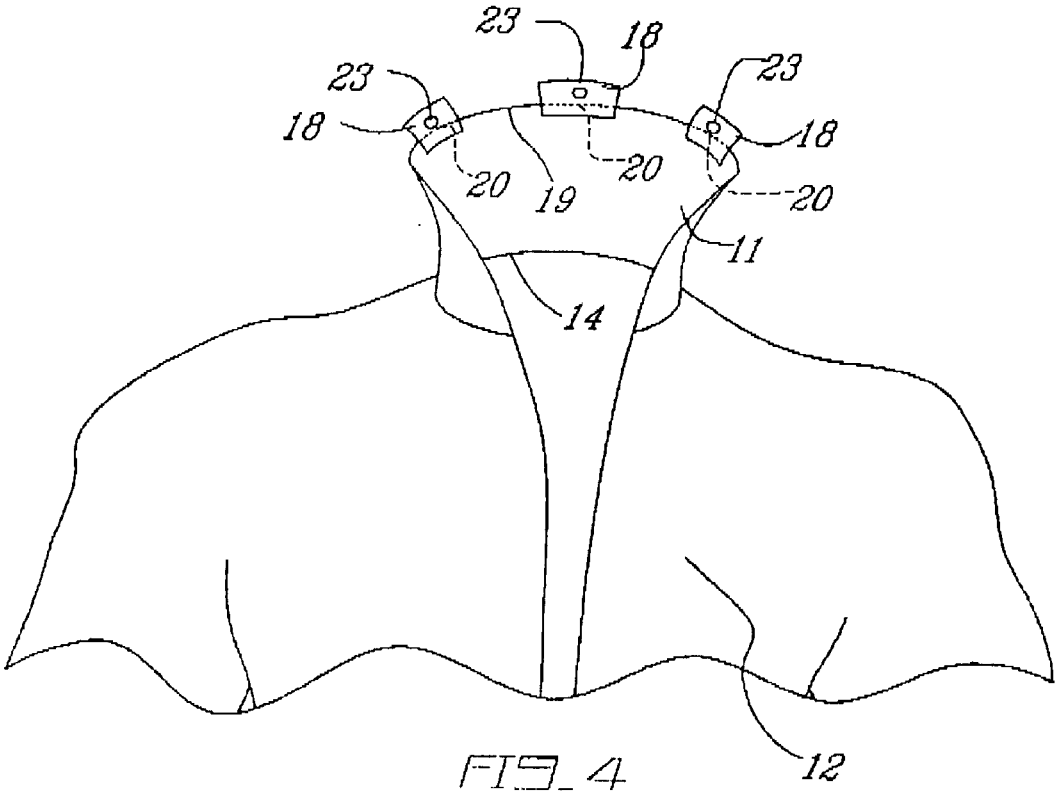
FIG. 4 is an alternative embodiment of the heat-resistant liner of FIG. 2.

FIG. 4 illustrates an alternative embodiment of inner liner 12 comprising a liner collar portion 11. As illustrated, flap 17 shown in FIGS. 1 to 3 has been replaced by a number of smaller projections 18 spaced along the folding edge or hinge 19. As illustrated, small projections 18 are sewn to liner collar portion 11 through stitching 20. However, it is understood that this alternative embodiment may comprise a liner collar portion 11 being made of a unitary piece of fabric which may be shaped to include small projections 18, therefore obviating the necessity of sewing small projections 18 to liner collar portion 11. Alternatively, the projection 17 of FIG. 2 may be unitary with the liner collar portion 11, or may also be sewn thereon along folding line or hinge 19, similar to the manner in which the small projections 18 are sewed to the liner collar portion 11. As illustrated, each small projection 18 may comprise a fastener mean 23, which may be a snap-on fastener mean or any other suitable or desired type of fastener mean, including a quick-release fastener mean as described above.

Figure 5:
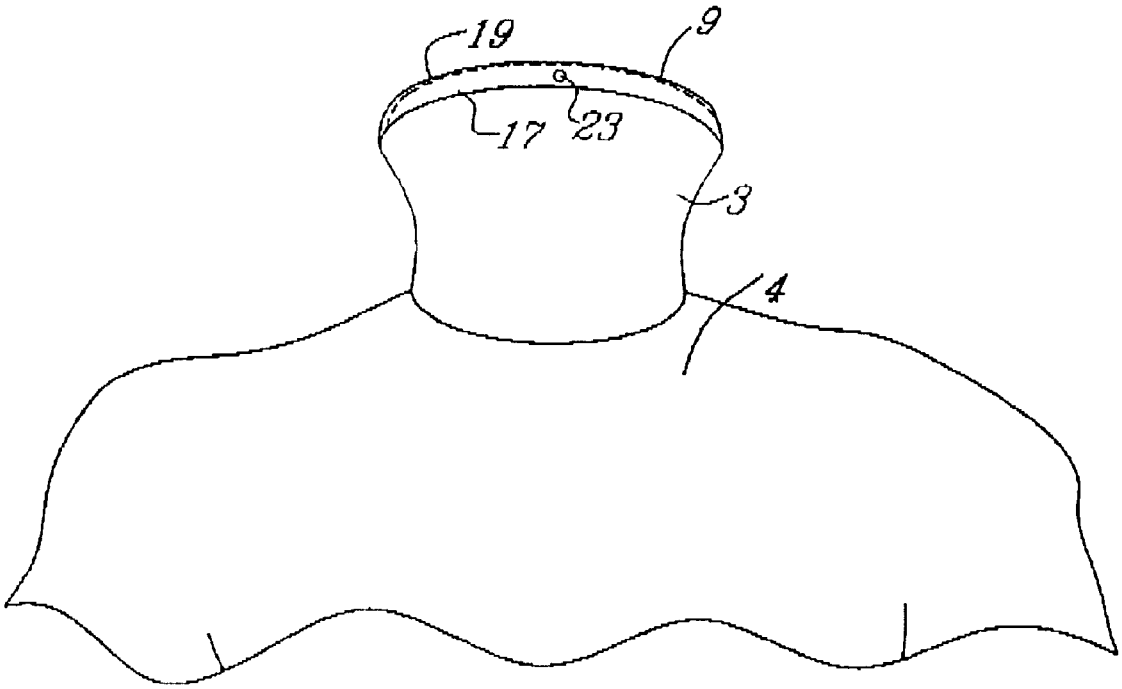
FIG. 5 is a rear elevation view of the shell neck portion and the liner neck portion.

FIG. 5 illustrates a rear elevation view of the collar portion of a firefighter's coat, showing the shell collar portion 3 and the flap 17 (of the liner collar portion, not shown), folded over and downwardly over the top of shell collar portion 3. Dotted line 9 illustrates the top or upper edge of shell collar portion 3, which is shown to be in contact with surface 15 of flap 17 which has been folded along fold line or hinge 19.

Figure 6:
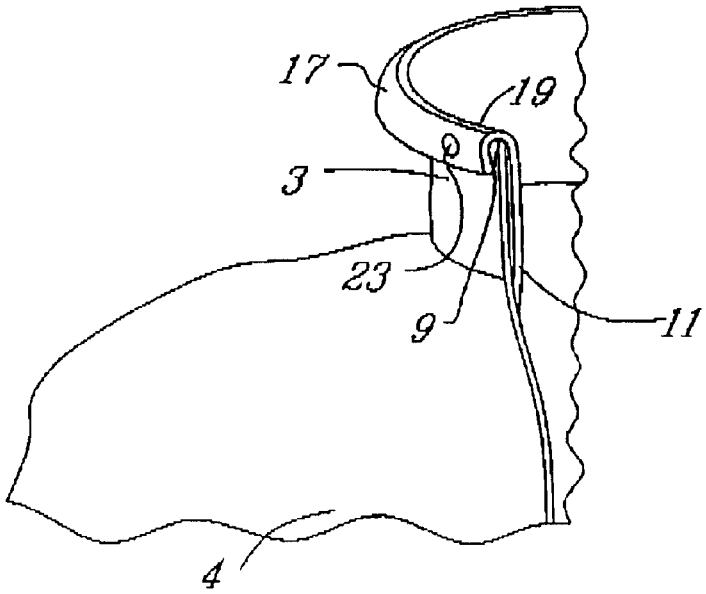
FIG. 6 is a front elevation view of the shell neck portion and the liner neck portion.

FIG. 6 illustrates perspective view of the collar portion of a firefighter's coat comprising a shell collar portion 3 and a liner collar portion 11. As illustrated, the top or upper edge 9 of shell collar portion 3 is shown abutting (i.e. being in contact) with the folded-over flap 17 along fold line or hinge 19 thereof.

Figure 7:
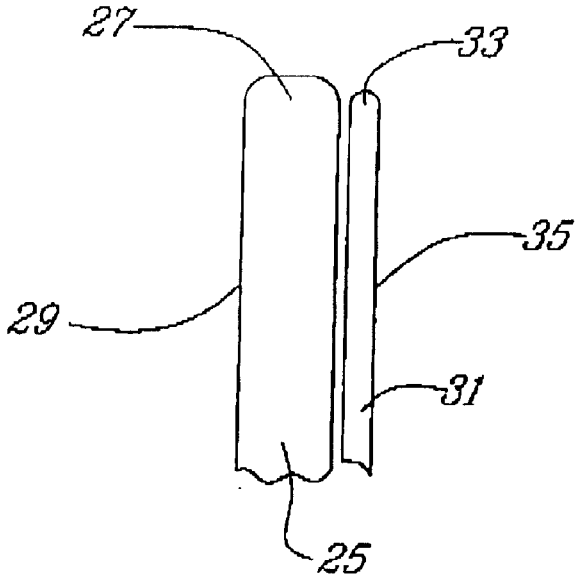
FIG. 7 is a side view of an alternative embodiment of the shell neck portion and the liner neck portion.

FIG. 7 illustrates an alternative embodiment of the present invention, wherein shell collar portion 25 and liner collar portion 31 are shown to be simply juxtaposed one beside the other without being connected one to the other.

Figure 8:
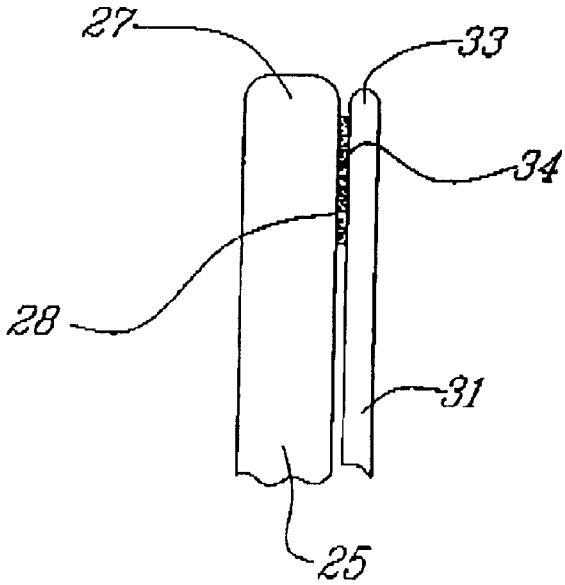
FIG. 8 is a side view of an alternative embodiment of the shell neck portion and the liner neck portion.

FIG. 8 illustrates a further alternative embodiment of the present invention, wherein shell collar portion 25 and liner collar portion 31 are shown removably connected one to the other through the use of loop-and-pile fastener means disposed adjacent their respective upper edges 27 and 33. In accordance with this embodiment, the height of shell collar portion 25 and the height of liner collar portion 31 are equal, i.e. substantially equal, and sufficient to cover the whole height of the neck of a firefighter. It is understood, that although the height of shell collar portion 25 and of liner collar portion 31 may be equal to each other, this height may vary along the circumferential length of the collar, to accommodate the changing physical configuration of a firefighter's neck. For example, the height near the front, i.e. covering the front of a firefighter's neck, may be smaller than the height covering the back of a firefighter's neck. Although illustrated as being connected to each other at or near the uppermost edge thereof, it is understood that loop-and-pile fastener means 28 and 34 may be disposed at other locations along the height of shell collar portion 25 and liner collar portion 31. Further, rather than loop and pile fastener means, it is understood that a slide fastener, i.e. a zipper®, may be used.

We claim:

1. A garment suitable for use by a firefighter, said garment comprising an outer, flame-resistant shell having a shell body for covering the torso and arms and a shell neck portion, and an inner, heat-resistant liner having a liner body portion for covering the torso and arms and a liner neck portion, said shell neck portion having a top edge and said liner neck portion having a top edge, wherein when said garment is worn by a firefighter, the top edge of said shell neck portion is disposed adjacent to the top edge of said liner neck portion, and wherein the top edge of said liner neck portion comprises a protrusion projecting therefrom, said protrusion being sized and configured to be folded down over the top edge of said shell neck portion such that the top edge of said shell neck portion abuts said protrusion, said protrusion and said liner neck portion comprising cooperating fastener means for removably securing said protrusion to said shell neck portion adjacent the top edge of said shell neck portion.

2. The garment of claim 1 wherein said fastener means comprise quick-release fastener means.

3. The garment of claim 2 wherein said quick -release fastener means are selected from a group comprising of pressure fasteners, loop-and-pile fasteners and slide fasteners.

4. A multi-layer garment for use by firefighters comprising an outer flame-resistant shell having a body and a shell neck portion projecting circumferentially therefrom, said shell neck portion having a superior edge, an inner heat-protective liner having a body and a liner neck portion projecting circumferentially therefrom, said liner neck portion having a top edge wherein said shell neck portion and said liner neck portion vertically overlap one another such that said superior edge and said top edge are adjacent one another, said liner neck portion comprising a flap permanently affixed thereto along a hinge line adjacent said top edge, said flap projecting from said top edge, said flap being configured and disposed to fold outwardly at said hinge line over said superior edge, such that said superior edge and said flap are in contact with each other when said flap is folded over, said flap and said liner neck portion comprising cooperating fastener means for removably securing said flap to said liner neck portion.

5. The multi-layer garment of claim 4 wherein said flap comprises two or more spaced- apart flaps disposed along said top edge.

6. The multi-layer garment of claim 4 wherein said fastener means comprises quick-release fastener means.

7. The multi-layer garment of claim 6 wherein said quick-release fastener means are selected from a group comprising of pressure fasteners, loop-and-pile fasteners and slide fasteners.

8. The multi-layer garment of claim 4 wherein the cooperating fastener disposed on said liner neck portion is disposed adjacent said superior edge thereof.

* * * * *